US005833774A

United States Patent [19]

Klein et al.

[11] Patent Number: 5,833,774

[45] Date of Patent: Nov. 10, 1998

[54] HIGH STRENGTH SILVER PALLADIUM ALLOY

[75] Inventors: Arthur S. Klein, Orange; Edward F. Smith, III, Madison, both of Conn.

[73] Assignee: The J. M. Ney Company, Bloomfield, Conn.

[21] Appl. No.: 835,665

[22] Filed: Apr. 10, 1997

[51] Int. Cl.[6] ..... C22C 30/00; C22C 5/06; C22C 5/08

[52] U.S. Cl. ..... 148/442; 148/430; 420/503; 420/587

[58] Field of Search ..... 420/503, 587; 148/430, 442

[56] References Cited

U.S. PATENT DOCUMENTS

| | | | |
|---|---|---|---|
| 1,935,897 | 11/1933 | Wise . | |
| 2,138,599 | 11/1938 | Gwyn, Jr. | 200/166 |
| 2,222,544 | 12/1940 | Spanner et al. | 120/109 |
| 4,980,245 | 12/1990 | Marino | 428/671 |
| 5,000,779 | 3/1991 | German et al. | 420/503 |
| 5,484,569 | 1/1996 | Klein et al. | 420/503 |

FOREIGN PATENT DOCUMENTS

| | | | |
|---|---|---|---|
| 277 088 | 3/1990 | Czechoslovakia . | |
| 59-107047 | 6/1984 | Japan | 420/587 |
| 59-107048 | 6/1984 | Japan | 420/587 |
| 59-113144 | 6/1984 | Japan | 420/587 |
| 59-113151 | 6/1984 | Japan | 420/587 |
| 59-179740 | 10/1984 | Japan | 420/587 |
| 59-182932 | 10/1984 | Japan | 420/587 |

*Primary Examiner*—Margery Phipps
*Attorney, Agent, or Firm*—Lappin & Kusmer LLP

[57] ABSTRACT

A silver/palladium alloy for electrical contact applications comprises, on a weight percent basis, 20–50 silver, 20–50 palladium, 20–40 copper, less than 1.0 nickel, 0.1–5 zinc, 0.01–0.3 boron, and up to 1 percent by weight of modifying elements selected from the group consisting of rhenium, ruthenium, gold, and platinum. The combination of zinc and boron provides an alloy of high strength and hardness and permits the use of lower amounts of both copper and palladium.

7 Claims, No Drawings

HIGH STRENGTH SILVER PALLADIUM ALLOY

BACKGROUND OF THE INVENTION

The present invention relates to precious metal alloys, and, more particularly, to such alloys which are especially adapted for electrical contact applications.

As is well known, precious metal alloys have been favored for a number of electrical contact applications where low contact resistance and/or noise is desired over extended periods of time. This is particularly true when the electrical products incorporating such elements may be exposed to relatively high temperatures, high humidity, sulfurous or other corrosive atmospheres, etc. Alloys with high gold and platinum contents were early favored for such applications, but the cost of such alloys became prohibitive for many applications and militated against more widespread use. This brought about efforts to develop alloys based upon less costly metals. As a result, palladium alloys became widely utilized in an effort to provide such desirable properties as corrosion and tarnish resistance at a lower cost. However, palladium alloys are also relatively expensive, and this cost has militated against still wider use.

U.S. Pat. No. 5,484,569 discloses a silver/palladium alloy having high oxidation and tarnish resistance, due to relatively low levels of copper and relatively high levels of nickel (at least 1%, and preferably greater amounts). That alloy relies on a synergistic effect of nickel and zinc to provide oxidation and tarnish resistance. However, that alloy does not exhibit the desired strength and hardness values for certain applications.

OBJECTS OF THE INVENTION

It is an object of the present invention to provide a novel silver/palladium alloy which exhibits a high strength and high hardness and provides good electrical properties.

It is also an object to provide such an alloy which is relatively low in cost in comparison to alloys having higher contents of noble metals.

Another object is to provide electrical components fabricated from such alloys and which exhibit desirable hardness and strength values as well as controllable formability for contact applications.

SUMMARY OF THE INVENTION

It has now been found that the foregoing and related objects may be readily attained in a silver/palladium alloy for electrical applications which comprises, on a percent by weight basis, 20–50 silver, 20–50 palladium, 20–40 copper, 0–0.5 nickel, 0.1–5 zinc, 0.01–0.3 boron, and up to 1 of modifying elements selected from the group consisting of rhenium, ruthenium, platinum and gold.

Preferably, silver comprises 28–45 percent by weight and palladium comprises 29–40 percent by weight. Copper preferably comprises 25–30 percent by weight, zinc preferably comprises 1 percent by weight, nickel preferably comprises 0 percent by weight, and boron preferably comprises about 0.15 percent by weight.

The alloy is formed into metal components which exhibit an elastic modulus of at least $14\times10^6$ p.s.i., and are capable of achieving hardness levels of greater than 350 Knoop with the appropriate thermal mechanical treatment.

DETAILED DESCRIPTION OF THE PREFERRED EMBODIMENTS

As indicated hereinbefore, the combination of silver with palladium provides most of the present alloy. The combination of zinc and boron in the desired ranges, along with reduction in nickel content to substantially zero, provides an alloy having superior strength and hardness while maintaining the amount of palladium and/or copper. Indeed, the presence of zinc and boron in combination in the alloy provides superior strength while permitting the amounts of both copper and palladium to be reduced relative to their levels in prior art silver/palladium alloys. Moreover, by proper combination of the elements described hereinafter in detail, the alloy exhibits good processing characteristics and mechanical strength together with a desirable modulus to provide the desired flexibility for moving contact applications.

The alloys of the present invention essentially contain palladium, silver, copper, zinc and boron and desirably contain small amounts of modifiers selected from the group consisting of rhenium, ruthenium, platinum and gold. The level of nickel in these alloys is reduced to substantially negligible amounts (less than 1 percent).

The silver content may range from as little as 20 percent to as much as 50 percent, and is preferably in the range of 28–45 percent.

Palladium is provided in the range of 20–50 percent, and preferably in the range of about 29–40 percent.

Copper is the next largest component of the alloy and is provided in the range of 20–40 percent, and preferably 25–30 percent. In these alloys, the palladium reacts with the copper component to provide a basis for the age hardening reaction to provide physical/mechanical properties of desirable characteristics. Moreover, it also increases the modulus.

Zinc is provided in the range of 0.1–5 percent, and preferably in the range of 0.5–1.5 percent. It participates in the second phase reaction which the alloy undergoes. It also serves as a deoxidant for the alloy during the initial casting into ingots.

Boron is provided in the range of 0.01 to 0.30 percent, and preferably about 0.15 percent. The boron is believed to participate synergistically with zinc in hardening and providing other desirable physical properties. For optimum effect of the zinc/boron enhancement, the amount of nickel must be kept to less than 1 percent, and preferably from 0–0.5 percent.

Small amounts of the modifying elements rhenium, ruthenium, platinum and gold in the range of 0–1.0 percent total do contribute some improvement in properties. Platinum provides nobility, and rhenium and ruthenium appear to act as grain refiners in this alloy. Gold contributes to oxidation resistance.

Two highly desirable commercial alloys of the present invention have the following compositions, respectively:

| | Percent by Weight | |
|---|---|---|
| Element | A (PE253) | B (PE260) |
| Silver | 44.85 | 28.9 |
| Palladium | 29 | 40 |
| Copper | 25 | 30 |
| Zinc | 1 | 1 |
| Boron | 0.15 | 0.10 |
| Nickel | 0 | 0 |
| Re, Ru, Pt, Au | — | — |

Hardness values for these alloys are, respectively, 395 Knoop at 100 grams for alloy A (PE253), and >500 Knoop at 100 grams for alloy B (PE260). To achieve these hardness levels, the alloys were rolled in strip form with a 60–70% reduction in area after a solution anneal followed by a precipitation hardening heat treatment. Alloy A was heat treated for 60 minutes at 700° F. and alloy B was heat treated for 60 minutes at 800° F.

These alloys are rolled into sheets which can be utilized to fabricate various electrical products including stationary contacts or connectors. Other uses include contacts in non-stationary applications such as commutators, potentiometers, and slip rings. The material can be drawn or otherwise formed into various types of electronic components because of its physical properties.

Processability is another significant property since the cast bar stock must be rolled into relatively thin strip or sheet. Accordingly, an alloy which evidences cracking at less than a 50 percent reduction is generally considered to have poor processing characteristics. The alloy can be used as wrought, and it may or may not be heat treated depending upon the intended application.

The following non-limiting examples are presented:

EXAMPLE I

An alloy comprising 35 weight percent silver, 35 weight percent palladium, and 30 weight percent copper was heat-treated at 700° F. for 45 minutes and 90 minutes. Alloy A, described above, was similarly heat-treated. The following hardness values (Knoop at 100 grams) were reported:

| Alloy | HT 700F 45 mins | HT 700F 90 mins |
|---|---|---|
| 35-35-30 | 348 | 358 |
| A | 363 | 379 |

Alloy A contains a reduced amount of copper relative to the 35-35-30 alloy, and zinc and boron in combination. In Alloy A and its variants, hardness is provided by a $PdCu_x$-type precipitate, in which x is typically 3. One would expect the hardness of the alloy to depend on the size and volume percent of the precipitated phase and to increase with increased copper and/or Pd, dependent on which element is stoichiometrically deficient. However, the addition of zinc and boron in small but effective amounts provides superior hardness with decreased amounts of copper and palladium.

EXAMPLE II

The following alloys were provided and heat treated at 60, 90 and 120 minutes from a 68 percent cold-worked state and from an annealed state. Hardness values are given in Knoop for a 100 gram load. See Tables I and II for comparative data.

The difference in hardness values for the alloys with negligible nickel (PE-260 and PE-261) relative to those with 1 percent nickel (PE-224 and PE-262) is significant: 30–60 Knoop points in the heat-treated from cold-worked state and 5–100$^+$ Knoop points in the heat-treated from annealed state.

Thus, it can be seen from the foregoing detailed specification that the present invention provides a novel silver/palladium alloy for electrical applications which exhibits good contact properties and superior hardness and strength values. The alloy can be fabricated relatively easily into metal sheet, or wire as a precursor to stamping or forming into the final geometry. As with many precipitation hardenable alloys, it is possible to achieve the desired hardness by properly heat treating solutionized (annealed) material. This allows for greater formability prior to heat treatment.

TABLE 1

| Composition, weight % | | | | | | | 68% C.W. | Heat Treated From 68% C.W. - Hardness, HK (100) | | | | | | | | | | | |
|---|---|---|---|---|---|---|---|---|---|---|---|---|---|---|---|---|---|---|---|
| Alloy | | | | | | | Hardness | 700° F. | | | 750° F. | | | 800° F. | | | 850° F. | | |
| Code | Ag | Pd | Cu | Zn | Ni | Boron | HK (100) | 60 | 90 | 120 | 60 | 90 | 120 | 60 | 90 | 120 | 60 | 90 | 120 |
| PE-260 | 28.9 | 40 | 30 | 1 | — | 0.1 | 333 | 464 | 490 | 490 | 488 | 477 | 483 | 504 | 464 | 452 | 476 | 490 | 437 |
| PE-224 | 27.9 | 40 | 30 | 1 | 1 | 0.1 | 330 | 410 | 415 | 414 | 435 | 435 | 439 | 439 | 414 | 405 | 426 | 432 | 387 |
| PE-261 | 28.85 | 40 | 30 | 1 | — | 0.15 | 345 | 479 | 483 | 488 | 482 | 489 | 482 | 499 | 463 | 464 | 486 | 490 | 440 |
| PE-262 | 27.35 | 40 | 30 | 1.5 | 1 | 0.15 | 343 | 416 | 410 | 431 | 448 | 451 | 454 | 464 | 434 | 436 | 443 | 443 | 414 |

TABLE II

| Composition, weight % | | | | | | | Annealed | Heat Treated From Annealed (1580° F./20 min @ 68% C.W. HK (100) | | | | | | | | | | | |
|---|---|---|---|---|---|---|---|---|---|---|---|---|---|---|---|---|---|---|---|
| Alloy | | | | | | | Hardness | 700° F. | | | 750° F. | | | 800° F. | | | 850° F. | | |
| Code | Ag | Pd | Cu | Zn | Ni | Boron | HK (100) | 60 | 90 | 120 | 60 | 90 | 120 | 60 | 90 | 120 | 60 | 90 | 120 |
| PE-260 | 28.9 | 40 | 30 | 1 | — | 0.1 | 253 | 338 | 345 | 362 | 497 | 496 | 485 | 467 | 464 | 464 | 465 | 457 | 428 |
| PE-224 | 27.9 | 40 | 30 | 1 | 1 | 0.1 | 244 | 340 | 335 | 339 | 362 | 367 | 358 | 412 | 416 | 413 | 420 | 425 | 397 |
| PE-261 | 28.85 | 40 | 30 | 1 | — | 0.15 | 253 | 341 | 347 | 356 | 485 | 497 | 490 | 465 | 473 | 469 | 471 | 454 | 494 |
| PE-262 | 27.35 | 40 | 30 | 1.5 | 1 | 0.15 | 247 | 335 | 341 | 345 | 383 | 390 | 389 | 428 | 411 | 421 | 417 | 401 | 386 |

We claim:

1. A silver/palladium alloy for electrical applications consisting essentially of:

(a) 20–50 percent by weight silver;

(b) 20–50 percent by weight palladium;

(c) 23–40 percent by weight copper;

(d) less than 1.0 percent by weight nickel;

(e) 0.1–5 percent by weight zinc;

(f) 0.01–0.3 percent by weight boron; and (g) up to 1.0 percent by weight modifying elements selected from the group consisting of rhenium, ruthenium, golds and platinum.

2. The silver/palladium alloy in accordance with claim 1 wherein silver comprises 28–45 percent by weight, palladium comprises 29–40 percent by weight, copper comprises 25–30 percent by weight, nickel comprises substantially 0–0.2 percent by weight, boron comprises 0.15 percent by weight, and zinc comprises 1 percent by weight.

3. A wrought metal electrical component formed from a silver/palladium alloy consisting essentially of:

(a) 20–50 percent by weight silver;

(b) 20–50 percent by weight palladium;

(c) 23–40 percent by weight copper;

(d) less than 1.0 percent by weight nickel;

(e) 0.1–5 percent by weight zinc;

(f) 0.01–0.3 percent by weight boron; and (g) up to 1.0 percent by weight modifying elements selected from the group consisting of rhenium, ruthenium, gold, and platinum.

4. The wrought metal electronic component in accordance with claim 3 wherein said component exhibits high strength and hardness.

5. The wrought metal electronic component in accordance with claim 4 wherein said component exhibits an annealed hardness of at least 200 Knoop, with a load of 100 grams.

6. The wrought metal electrical component in accordance with claim 4 wherein said component exhibits a hardness of at least 300 Knoop, with a load of 100 grams, after a precipitation heat treatment.

7. The wrought metal electrical component in accordance with claim 4 wherein said component exhibits a cold worked hardness of between 200 and 400 Knoop, with a load of 100 grams.

* * * * *